United States Patent [19]

Sobel

[11] Patent Number: 4,631,997

[45] Date of Patent: Dec. 30, 1986

[54] METHOD FOR SIMULTANEOUSLY CUTTING A PLURALITY OF PICTURE FRAME MATS

[76] Inventor: David D. Sobel, 15415 N. 22nd St., Phoenix, Ariz. 85022

[21] Appl. No.: 830,359

[22] Filed: Feb. 18, 1986

Related U.S. Application Data

[62] Division of Ser. No. 655,249, Sep. 28, 1984, Pat. No. 4,590,834.

[51] Int. Cl.[4] ..... B26D 3/02; B26D 7/02

[52] U.S. Cl. ..... 83/29; 83/36; 83/49; 83/455

[58] Field of Search ..... 83/29, 36, 49, 455, 83/614

[56] References Cited

U.S. PATENT DOCUMENTS

| | | | |
|---|---|---|---|
| 611,238 | 9/1898 | Drinkaus | 83/614 X |
| 3,213,736 | 10/1965 | Keaton | 83/620 X |
| 3,513,744 | 5/1970 | Hershberger | 83/614 X |
| 3,996,827 | 12/1976 | Logan | 83/455 |
| 4,018,120 | 4/1977 | Pastore | 83/455 X |
| 4,231,275 | 11/1980 | Onishi | 83/862 |

*Primary Examiner*—James M. Meister

*Attorney, Agent, or Firm*—Bauer & Amer

[57] ABSTRACT

A method and apparatus for simultaneously cutting a plurality of picture frame mats with picture display windows in a single operative procedure by initially arranging the mats in a reverse and inverted order and cutting them with an apparatus mounting a plurality of cutters, one for each mat, at an angle to the planes of the mats and thereafter separating and rearranging the mats to frame the picture in their desired picture frame array.

4 Claims, 14 Drawing Figures

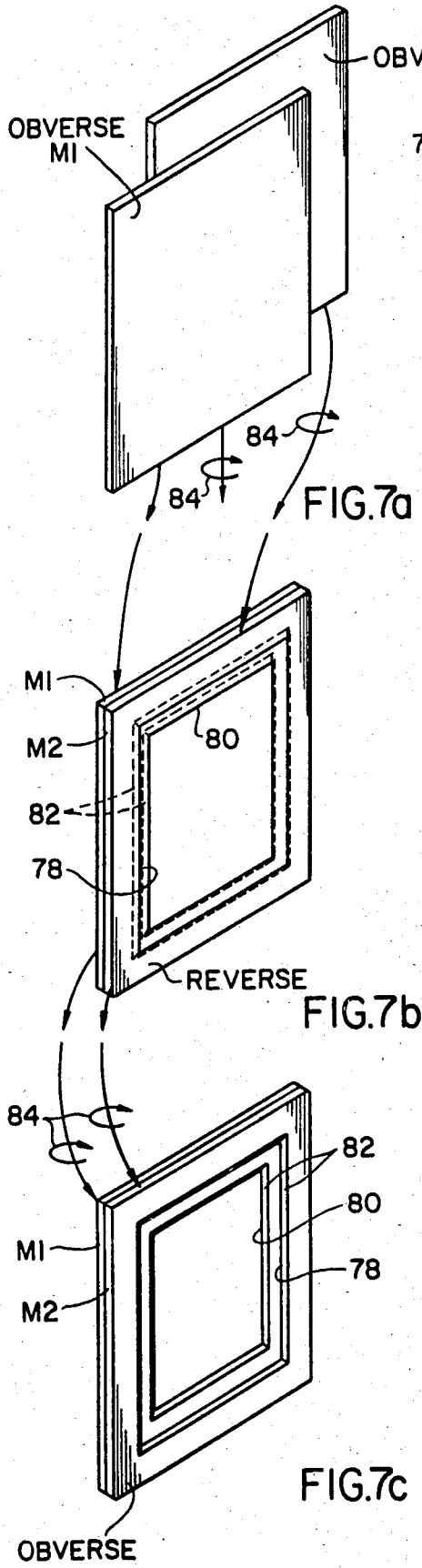
FIG.7a
FIG.7b
FIG.7c
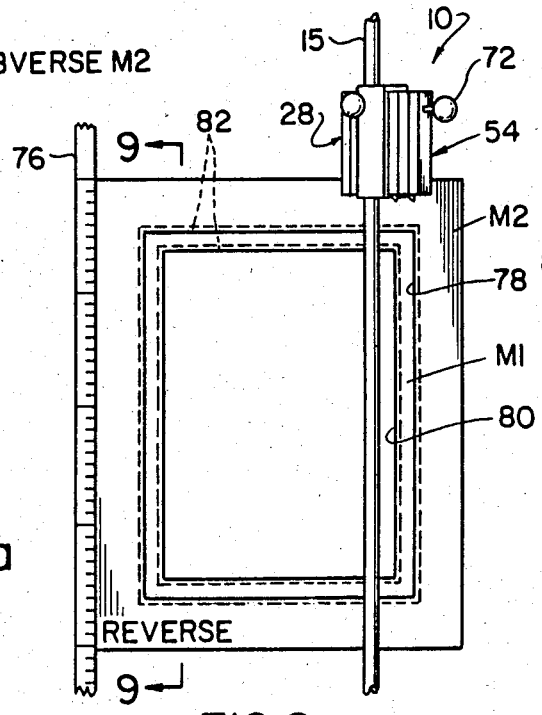
FIG.8
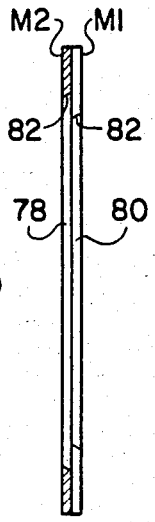
FIG.9
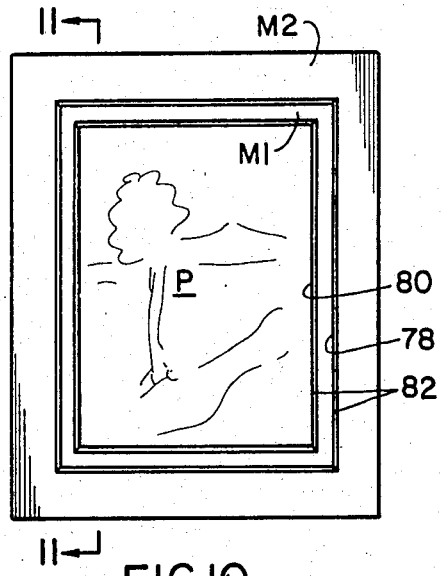
FIG.10
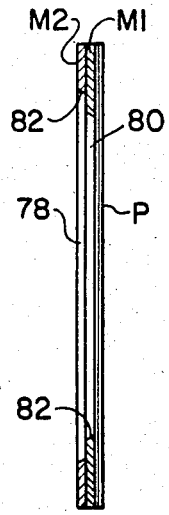
FIG.11
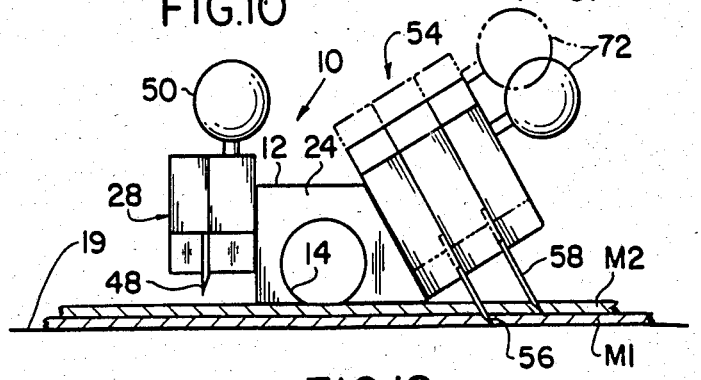
FIG.12

METHOD FOR SIMULTANEOUSLY CUTTING A PLURALITY OF PICTURE FRAME MATS

This is a division of application Ser. No. 655,249, filed Sept. 28, 1984, now U.S. Pat. No. 4,590,834.

BACKGROUND OF THE INVENTION

The present invention relates to a method and apparatus of making and for forming picture frame mats to size and particularly for forming simultaneously a double picture frame matting.

In the picture frame industry, the framer is often called upon to provide a plurality of decoratively colored mats to mount a picture within a frame so as to more artistically offset and display the coloring of the picture through an opening or window cut in each of the mats. Oftentimes, each of the mats is colored to provide a contrasting color scheme with that of the frame and/or with that of the picture. At times, each mat is also provided with a decorative surface which contrasts with the picture and the frame as well. Frequently a second and even a third or more mats may be added and overlayed on each as additional picture display borders with each mat contrasting in color with both the other mats and the frame and the picture to be displayed through their windows.

It is well known in the picture framing industry that the size of the mats, their openings or picture display windows which border the picture or pictures are critical in that they must conform not only to the size of the frame but also to the sizes of the displayed picture or pictures. In addition, the relative dimensions of the display openings or windows of the mats are critical because they must be uniformly shaped, equally spaced, perfectly mitered and bevelled along the edges of the window framing openings with acute angles to the planes of the mats. Such bevelled edges usually are of a further contrasting color to that of both the face of the mats, the frame and also the picture.

Because of the criticality of all of the requirements of the display mats, cutting each such mat is considered an art and has been a laborious task because of the difficulty of cutting each mat evenly, with straight edges and lines parallel and uniform to each other. Heretofore it has been a problem to provide more than one mat with a window opening, the side edges of which are absolutely parallel to and conform absolutely perfectly evenly with and uniformly with the window display openings of other mats used in and cut separately for the picture frame. Various cutting devices have been known which facilitate the cutting of picture frame mats. To this effect, reference may be made to the Logan U.S. Pat. No. 3,996,827 and to U.S. Pat. Nos. 4,158,977 and 3,213,736 as being illustrative of the prior art.

Commercial cutting apparatuses have been available through G&M Manufacturing Co., 5755 Gallant Drive, Jackson, Miss.; Keeton Products International, Inc., Model Nos. KK210, KK248, KK410, and KK448 and the Vertical Glass and Cardboard Cutter Model 300 of the Logan Manufacturing Co.

When using the known apparatuses, the framer must first cut each side of each mat accurately and, therefore, laboriously and separately one at a time. If a single mat is required, at least four separate cutting strokes are necessary to provide a proper picture display opening or window. If two or more overlying mats are required to display a picture, each mat must be cut separately in the manner as described. The four cutting strokes on each mat must be exactly equal to, uniform with and parallel with the strokes cut on each other mat. If any one of the edges of the openings of any one of the mats does not match perfectly the corresponding edge opening of another mat, the appearance of the mat design completely detracts from the picture and diminishes from its effectiveness. At the present time, there is no known method or apparatus for cutting two or more mats simultaneously, uniformly and perfectly equally spaced and parallel with each other without the great labor and consumption of time as was described and known in the prior art.

Thus, in the past, the framer was required to exercise great care to mark each mat with the desired window opening by measuring and sizing one mat with respect to each of the other mats to be cut. Then each cut had to be made separately in each mat with great care to assure that it was parallel to and conformed perfectly with the corresponding edges or walls in precise relative spacing with respect to every other mat. The duplication of efforts required to be performed on each mat increased the possibility and opportunity for miscalculation and error as well as damage to and loss of one or more of the mats, all of which is expensive.

The present invention eliminates all the requirements of the duplicative calculations, markings, cuttings and labor as well as the loss of material. The present invention enables all of the mats to be cut in a single operation uniformly, equally spaced, with all of the cuts made parallel, each to the other, without error and without the loss or damage to any of the materials that are utilized.

It is an object of the present invention to provide a method and an apparatus for accurately cutting and forming double or multiple mats with picture display windows and openings wherein each of the mats is cut simultaneously with the other.

Further objects and advantages will become apparent from the following disclosure of the present invention.

SUMMARY OF THE INVENTION

According to the present invention, a plurality of matching picture frame mats are selected and simultaneously cut by first reversing the relative arrangement of the surfaces of the mat and then inverting them in order so that the outer mat used for display becomes the inner or lower mat during the cutting procedure and the inner mat used for display of the picture becomes the outer mat during the cutting procedure. When in this second cutting position, the plural mats are simultaneously cut by a single cutting apparatus having two or more blades, each blade being used for cutting a respective mat, and each blade being spaced parallel to the other, and each at an angle to the surface of the mats to produce a selected bevelled edge surface about the mat window display or opening.

One blade is used to cut through all of the mats simultaneously to produce the smallest desired opening while the others of the blades each cut through respective ones of the mats to form window display openings therein which are perfectly uniform and parallel to and equally spaced from each of the other display openings. The mats are then separated from each other, reoriented by rotating them into their desired end display array and placed over the picture so that the picture is positioned behind the reverse sides of each of the mats.

A novel single cutting apparatus is provided for accomplishing the aforedescribed method. The apparatus comprises a movable cutter support that is adapted to fit on and slide along and relative to the guide rod of most the aforementioned conventional presently known cutting tables so as to enable the continued use of such cutting tables without rendering them obsolete by the present invention.

On one side of the cutter support block is a blade clamp that is mounted to pivot in a plane perpendicular to the surface of the mat. Such clamp holds a single blade and is intended to cut square outer peripheral edges about the mats so as to enable them to be fitted perfectly within a frame in a manner such as has been performed with conventional mat cutting apparatuses in the past.

On the other side of the block there is mounted a blade clamp which is pivotal in a plane at an angle supplemental to the angle of the bevelled edge to be produced about the border of the window display opening to be produced in each mat. The angularly movable clamp has mounted therein a plurality of blades which is spaced parallel from the other by an amount corresponding to the difference in size between the central openings to be made simultaneously in each of the mats. The blades are further arranged so that at least one of them will cut through all of the superimposed mats to thereby cut the bottom or lowermost mat, while the others of the blades will cut through only respective ones of the top or upper ones of the superimposed mats.

Preferably, the blade clamps are spring biased to a normally inactive cutting position so that the blades are automatically positioned out of contact with the mat and in a location that positions them free of contact with the hands of the user. The clamps are also formed so that the blades are removable and adjustable in cutting depth.

Full details of both the method and of the cutting apparatus of the present invention are set forth in the following description and as illustrated in the accompanying drawings.

Figure 6:
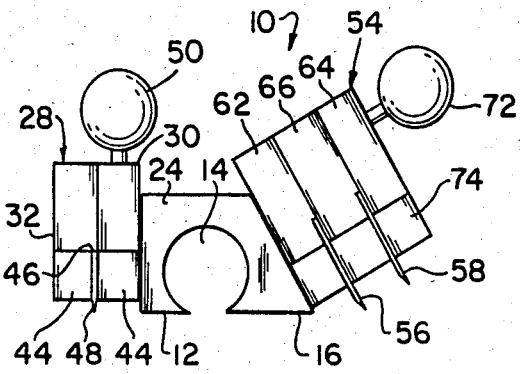
FIG. 6 is a front elevational view of the cutting instrument shown in FIG. 1.

FIGS. *7a* through *7c* are a sequence of perspective views showing the form of the mats being cut and arranged in accordance with the method of the present invention;

FIG. 8 is a plan view of two mats placed upon a cutting board during the process of being cut according to the present invention;

FIG. 9 is a cross-sectional view of the mats taken along lines 9—9 of FIG. 8;

FIG. 10 is a plan view of the completely cut mat shown placed over a picture;

FIG. 11 is a cross-sectional view taken along lines 11—11 of FIG. 10; and FIG. 12 is a view of the cutter instrument similar to FIG. 6 with the mats arranged therebeneath as in FIGS. 8 and 9 and being cut thereby.

DESCRIPTION OF THE INVENTION

Before turning to the method by which the mats are actually cut, it will be more convenient to describe the apparatus of the present invention. As is seen in FIGS. 1 through 6 and 12, the apparatus includes a cutting instrument generally identified by the numeral 10 comprising a central cutter support block 12 which is of sufficient bulk to be easily grasped in the palm of the hand. Provided along its lower edge the block 12 has a partially closed through guide hole 14 having a generally circular cross-section so as to fit over and to slide along a conforming round guide rod 15 (FIG. 8) as is conventionally provided in prior art cutting apparatuses of the type previously mentioned.

The bottom surface 16 of the block 12 is smooth for smooth gliding movement along the surfaces of the mats to be cut. Because the bottom surface 16 intersects the circular hole 14 along a chordal line thereof, it leaves an open elongated slot 18 therein. The flat surface 16 is adapted to slide and glide smoothly and unrestrictedly in its movement over and relative to a supporting cutting surface 19 of the conventionally known apparatuses as is shown in FIG. 12.

One of the lateral sides 20 of the block 12 is substantially upright or positioned normal to the bottom surface 16 so as to be perpendicular relative to the mat that is to be cut by a blade which pivots relative to such side. The opposite lateral side 22 of the block is slanted or tapered to form an acute included angle with the bottom surface 16. The side 22 is positioned in a generally downward and outward direction supplemental to the customary oblique angular degree of bevel for the picture frame mat.

Figure 1:
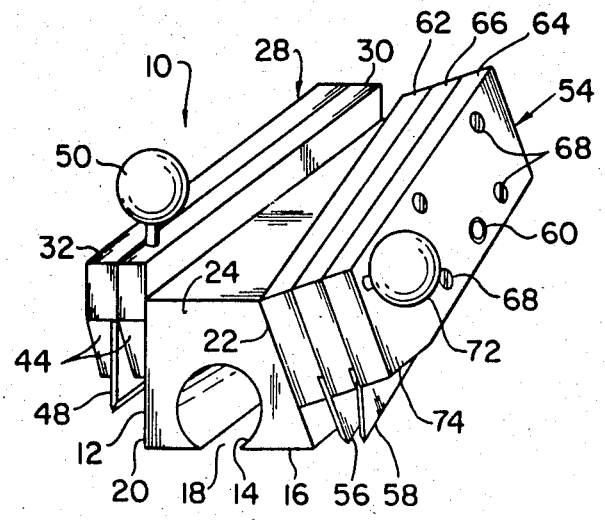
FIG. 1 is a perspective view of the cutting instrument of the present invention in its inactive cutting position.

It is to be noted that when placed on the supporting rod 15, the block 12 will be movable axially and reciprocably along the same. In practice, the cutting of the frame mats is accomplished more easily when the block 12 and its related structural details to be described hereinafter are drawn or pulled toward the operator or user. This should become more apparent as the description proceeds. For convenience, and without limiting the invention, as seen in FIG. 1 the face 24 may be referred to as the rear or trailing end of the block and the face 26 as the front or leading end of the block in the description of the operation thereof.

Mounted on the substantially upright or perpendicular side 20 of the block 12 is a blade clamp 28 which pivots relative to the side and substantially perpendicular to the surface 16. The blade clamp 28 comprises an inner plate 30 and an outer plate 32. The inner plate 30 is mounted on a pivot pin 34 that is set toward the rear of the clamp 28 while the outer plate 32 is held fast to it by several removable set screws 36. A spring 38 is connected between two relatively fixed mounting screws 40 and 42, with the screw 40 fixed to the rear face of the plate 30 while the screw 42 is fixed to the body 12 to cause the entire clamp 28 to bias or move counterclockwise so as to maintain the end of the clamp normally raised above the bottom surface 16 of the body 12 into a normally inactive cutting position.

The lower corners 44 of both plates 30 and 32 are chamfered or cut back so that when the clamp 28 is in its inactive non-cutting position, a cutting blade 48, adjustably mounted in the clamp between the plates 30 and 32, is raised above and does not extend below the surface 16 of the block 12. The interior surfaces of the plates 30 and 32 are cut with an elongated recess 46 leaving a space for the insertion of the cutting blade or similar cutting element 48. By loosening the screws 36 the blade 48 may be adjusted in cutting depth or removed and a new one substituted or reinserted in its place.

Manipulation of the clamp 28 is afforded by a small knob-like handle 50 that is provided on the top thereof to pivot the clamp manually in opposition to the normal urging or bias of the spring 38. On the opposite slanted wall 24 of the block 12 is a multiple blade clamp generally identified by the numeral 54 for holding a plurality of blades, only two of which are shown and identified as 56 and 58.

The blade clamp 54 is pivotally mounted by a pivot pin 60 to the slanted side wall 22 of the block 12 to swivel in a plane parallel to the side walls 22 and oblique to the surface 16 and to the support surface 19 and mats supported for cutting thereon. Fixedly secured together to form the clamp are blade securing plates 62, 64 and 66. The inner and outer plates 62 and 64 sandwich the intermediate plate 66 with the plural blades 56 and 58 mounted therebetween and locked in position by a plurality of removable or adjustable screws or other securing means 68.

Figure 3:
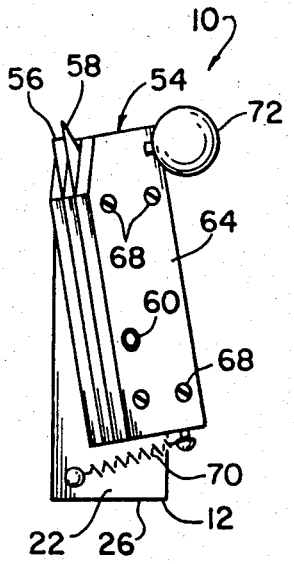
FIG. 3 is an elevational view of the left side of the cutting instrument shown in FIG. 2.
Figure 2:
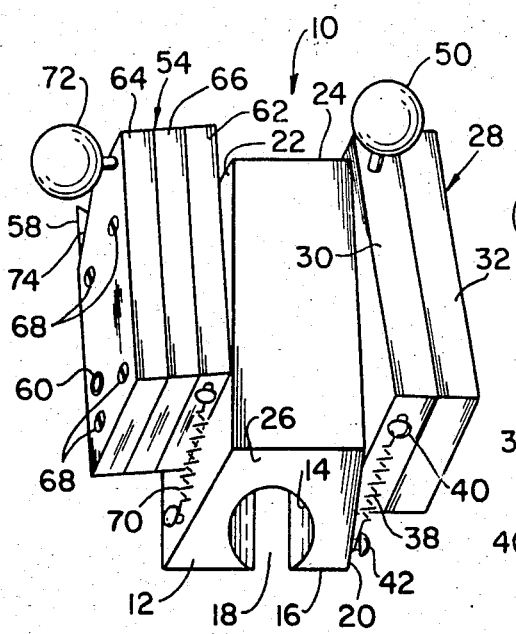
FIG. 2 is a rear perspective view of the cutting instrument shown in FIG. 1 with the blade clamps thereof in active cutting positions.
Figure 4:
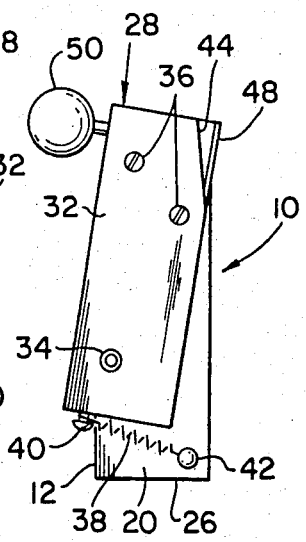
FIG. 4 is an elevational view of the right side of the cutting instrument shown in FIG. 2.
Figure 5:
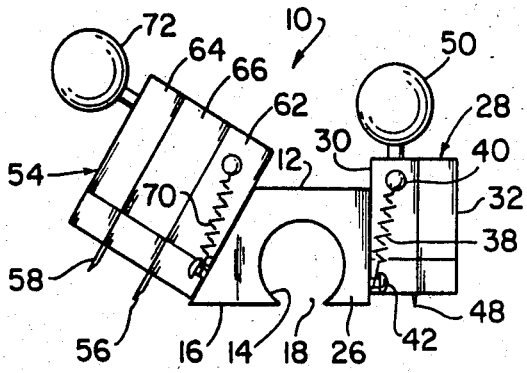
FIG. 5 is a rear elevational view of the cutting instrument shown in FIG. 2.

The inner one of the blades 56 may be held in a blade recess between the plates 62 and 68 in the manner described with respect to the blade 48. The blade 58 may be similarly mounted, but its cutting end will extend offset beyond that of the rear of the blade 56 as is seen in FIG. 3 to assure that it will cut through its respective mat without penetrating and cutting through the mat that is to be cut by the blade 56. Although only two blades are shown mounted for cutting by the clamp 54, it should be apparent to those who are skilled in the art that the clamp may mount additional blades for cutting respective ones of frame mats in accordance with the teaching of this invention.

The multiple blade clamp 54 is provided with a return spring 70 and a manually operable handle 74. As described with respect to the clamp 26, the front corners of the clamp 54 also may be chamfered at 74 to expose the cutting blades 56 and 58. The knob 72 operates in opposition to the spring 60 which tends normally to return the clamp 54 to its inactive cutting position with the blades 56 and 58 raised above the level of the surface 16 so that at all times when the clamp 54 is not in use and is not physically and manually depressed at the knob 72, the blades 56 and 58 are removed from their cutting position and are returned to their inactive cutting position.

FIGS. 7 to 11 illustrate the method of the present invention. It is to be appreciated that the cutting instrument 10 may be utilized with virtually any conventional and known cutting apparatus provided with an elongated guide or drawbar of the type 15 along which the cutting instrument may be guided for cutting movement relative to a support surface 19 on which the mats may be supported.

With the cutting instrument 10 mounted along its guide bar 15 in the conventional manner, the operator selects a plurality of picture frame mats of desired color and size to be cut with windows or picture display openings. Although it will be clear that more than just two such mats may be cut according to the present invention, the following description may be made with respect to only two such mats. The selected mats are identified in FIGS. 7 to 12 as M1 and M2. In their final display arrangement as is illustrated in FIGS. *7c*, 10 and 11, mat M1 is conveniently referred to as the inner remote mat or blank while the outer or proximal mat or blank is identified as M2. The mats are arranged in their initial relationship as is shown in FIG. *7a* in which their front or "obverse" faces are directed toward the viewer so proper selection of the mats can be confirmed. The mats are then arranged in their next or second positions as is shown in *7b* preparatory to cutting them.

The rearrangement to their second or cutting position requires the mats to be moved so that they are inverted in their relative order, so that the mat M1 is now behind the mat M2. The mats are also rotated about their axes as at 84 in FIG. *7a* so that their "reverse" faces are directed upward toward the viewer or framer so as to be presented to face the cutter instrument 10. The rotation of the mats M1 and M2 to the reverse positions can be accomplished either before or after or even while the mats M1 and M2 are being inverted in order.

When in their second rearranged relationship as shown in FIG. *7b*, the "obverse" faces of the mats M1 and M2 are directed away from the viewer and toward the support surface 19. The overlaid mats M1 and M2 are then placed upon to be supported by the support surface 19 with their one side edges located in abutment and held against a ruled straightedge 76 as is illustrated diagrammatically in FIG. 8.

The cutting instrument 10 is then ready to be used in its conventional manner for cooperative guided movement along the guide rod 15. After the dimensions of the windows or picture framing openings 78 and 80 to be provided in the mats M1 and M2 are decided upon, the points of the cutting blades 56 and 58 are pressed downward at the rear or trailing end 24 to penetrate into and through their respective mats by the manual application of a downward pressure against the handle 72 of the multi-blade clamp 54. When in their solid line position as shown clearly in FIG. 12, the inner blade 56 will penetrate completely through both mats M2 and M1 sequentially, while the outer blade 58 will penetrate completely through only the upper mat M2. Both blades penetrate and cut the mats from the reverse sides thereof toward the obverse sides.

As seen in FIG. 12, the blade 56 cuts both mats M2 and M1 from their reverse sides toward their obverse sides while the blade 58 cuts only the upper mat M2, and also in a direction from its reverse side toward its obverse side. However, to assure a complete or through cutting of the mat M2 as is accomplished by the blade 58, the blade penetrates the mat M2 beyond the reverse side and cuts slightly into the reverse side of the mat M1 which is positioned therebeneath to slightly score the same without cutting through it.

Once the depth of the cutting penetration is established by the pointed or cutting edges of the blades 56 and 58 beyond the defines of the clamp 54, the cutting instrument 10 may now be slid along the guide rod 15 in the direction of the forward or leading end 26 until the blades have completed the full lengths of the cuts desired for each of the sides of the windows 78 and 80. Adjustment of each blade 56 and 58 individually may be accomplished by the separation of the plates 62, 64, and 66 by releasing the screws 68 and then resecuring them after the desired adjustment. All sides of the windows 78 and 80 may be cut by rotating both mats M1 and M2 in unison against the straightedge 76 after each cut is performed.

During the performance of each cut of the windows 78 and 80, it will be seen from the solid line position of FIG. 12 that the blade 58 forms the outline of the larger window 78 in the mat M2 while the blade 56 forms the smaller window 80 in the mat M1. However, because blade 56 also cuts through both mats M1 and M2, it cuts a border in the mat M2 that is defined by the space between the blades 56 and 58. Since the border of mat M2 that is cut by the blades is within the defines of the larger window 78, such border forms a part of the scrap or waste of the mat M2 and is, therefore, intended to be discarded. However, in practice, such border may be retained by the framer who may find that the same is capable of reuse with a smaller picture at a later time.

It will be noted that the oblique cuts made by each of the blades are directed at obtuse angles in each mat with respect to the support surface 17. Such obtuse angle is supplemental to the angle of the bevel 82 that is produced about each of the windows 78 and 80. Thus, the obtuse angular cuts are used to advantage to produce acute angled bevelled surface borders 82 about each window 78 and 80 as will become clear. It will be seen from FIGS. 8 and 9 that each cut is made on the reverse side of each mat to produce smooth and accurate bevels and to produce perfectly mitered corners.

Hence, each window that is produced by the plural cutting blades 56 and 58 is exactly the same as the other and each of the window sides is perfectly parallel to each other. After each side of the windows is cut by repeated rotations of the mats in unison and in their reverse and inverted order, the clamp handle 72 is released to enable the clamp 54 and its blades to be returned from their solid line active cutting positions to their broken line inactive cutting positions (FIG. 12) as a result of the normal urging of the spring 70.

The windowed mats as are illustrated in FIG. 7*b* are now ready to be separated and rearranged into their desired order for picture frame display. Before describing such rearrangements in accordance with the method of the invention, it should be apparent to one skilled in the art that the plurality of mats that have been cut simultaneously in a single time saving operation with their windows formed perfectly uniform, even and parallel, merely exemplify the teaching of the invention which may be applied to more than just the two mats that are illustrated. Hence, the description of the formation of the windows in the two mats is not to be construed as a limitation upon the scope of the invention.

The mats are now lifted from the cutter support and its surface 19. The window scrap cut in each mat is removed as was described to reveal and to expose the window opening 78 and 80. The blank that is removed from the mat M1 for the smaller window 80 will be in a single piece. The larger window 78 is the result of the two blanks that are cut between the blades 58 and 60 as is seen in FIG. 12. The plural mats must now be rearranged to their picture display relationship as is shown in FIGS. 7*c*, 10 and 11, wherein the picture P thereshown is positioned within the frame openings behind the reverse side or face of the mat M2.

When immediately removed from the surface 19, the mats are still in their inverted and reversed cut positions as is shown in FIGS. 7*b*, 8 and 9. To rearrange them to their display relationship as is shown in FIGS. 7*c*, 10 and 11, it is merely necessary to first separate the mats from touching engagement with each other. Then each mat is rotated about its axis as is shown by the arrows 84 so their obverse sides face outward toward the viewer and their reverse sides or surfaces face toward the rear or toward the picture P as is seen in FIGS. 10 and 11.

In this final picture display arrangement, the slight scoring penetration made in the reverse face of the mat M2 by the blade 56 is now completely obscured from view because it faces the picture P behind it and, therefore, cannot be seen by the viewer. It will be noted that the bevelled edges 82 formed about each of the openings 78 and 80 are perfectly uniform, even and parallel with each other, and thus appear as a single opening since they were cut in a single simultaneous cutting operation. The cutter blade 48 may be used in the manner conventional in the prior art to trim the outer edges of the mats M1 and M2 so they may be sized to fit centrally within a selected frame.

While there have been shown and described and pointed out the fundamental novel features of the invention as applied to a preferred embodiment thereof, it will be understood that various omissions and substitutions and changes in the form and details of the device illustrated and in its operation may be made by those skilled in the art without departing from the spirit of the invention. It is the intention, therefore, to be limited only as indicated by the scope of the claims appended hereto.

What is claimed is:

1. The method of simultaneously cutting differently sized picture framing openings in at least two overlying picture frame mats with a single cutting apparatus having a plurality of relatively spaced cutters comprising arranging the picture frame mats in their desired position of display with the obverse side of each mat being toward the viewer and the reverse side of each mat toward the object to be displayed and the front mat closer to the viewer having a larger opening than the rear mat closer to the display object, rearranging said mats to a cutting position by reversing the order of said mats and rotating the same so their reverse sides are toward the viewer, cutting both of said mats while they are in said cutting position in a cutting operation with the single cutting apparatus to cut picture frame openings in each of the mats to produce in the mat closer to the viewer a picture frame opening that is larger than the picture frame opening produced in the mat farther from the viewer, and returning said mats from said cutting position to said desired position of display.

2. The method as in claim 1, cutting at least a mat at an angle oblique to the obverse side thereof.

3. The method as in claim 1, cutting through all of the mats to produce openings in each of them and cutting openings in only selected ones of the mats with selected ones of the plurality of cutters simultaneously.

4. A method for simultaneously cutting the bevelled side edges of openings in at least a plurality of overlying picture frame mats with the upper mat having an opening uniformly larger about its periphery than the opening of the lower mat comprising selecting upper and lower mats each having obverse and reverse surfaces, moving said mats so that said reverse surfaces face upward, inverting the position of said mats so that said upper mat is beneath said lower mat, simultaneously cutting openings in both mats from the reversed sides thereof employing inner and outer relatively spaced blades each corresponding to the difference in the sizes of the opening of each of said mats and each said blade being disposed in an angle oblique to the surface of said mats, the inner one of said blades cutting through both said mats and the outer one of said blades cutting through said top mat, and rearranging said mats so that said upper mat is on top of said lower mat and reversing said mats so that said reverse sides face up.

* * * * *